United States Patent [19]

Hubbartt

[11] 3,936,931

[45] Feb. 10, 1976

[54] METHOD EMPLOYING A LEAD HOLDER TO RETAIN A LEAD CONNECTION ON AN ELECTRICAL COIL

[75] Inventor: Donald S. Hubbartt, Winnebago, Ill.

[73] Assignee: Barber-Colman Company, Rockford, Ill.

[22] Filed: June 5, 1974

[21] Appl. No.: 476,421

[52] U.S. Cl. ..... 29/605; 29/628; 174/138 R; 174/175; 336/192

[51] Int. Cl.[2] ..... H01F 41/10; H01F 5/04

[58] Field of Search ..... 174/138 R, 138 F, 175; 29/602, 605, 628; 310/194, 234, 71; 335/250, 282, 299; 336/192, 198, 208; 339/220 C, 221 M, 276 C, 277 C, 278 A

[56] References Cited

UNITED STATES PATENTS

| | | | |
|---|---|---|---|
| 2,249,057 | 7/1941 | Stahl | 336/192 |
| 2,992,370 | 7/1961 | Laviana | 339/276 C X |
| 3,355,801 | 12/1967 | Priddy | 336/192 X |
| 3,407,264 | 10/1968 | Cull | 174/138 F |
| 3,436,709 | 4/1969 | Schapira et al. | 336/192 |
| 3,453,575 | 7/1969 | Davis | 336/192 |
| 3,466,381 | 9/1969 | Boehmke | 336/192 X |
| 3,609,616 | 9/1971 | Dumeige | 336/192 |
| 3,634,878 | 1/1972 | Davis | 336/192 |

FOREIGN PATENTS OR APPLICATIONS

| | | | |
|---|---|---|---|
| 975,405 | 10/1950 | France | 174/175 |
| 1,512,441 | 1/1968 | France | 174/175 |
| 2,014,720 | 10/1971 | Germany | 336/192 |

*Primary Examiner*—Laramie E. Askin
*Attorney, Agent, or Firm*—A. Richard Koch

[57] ABSTRACT

A method employing a wire holder to retain side-by-side lead and magnet wires, joined together at adjacent ends, in a fixed position with respect to and insulated from a magnet coil on which it is mounted. It relieves strain on the magnet wire.

3 Claims, 5 Drawing Figures

METHOD EMPLOYING A LEAD HOLDER TO RETAIN A LEAD CONNECTION ON AN ELECTRICAL COIL

BACKGROUND OF THE INVENTION

Small electric coils, such as may be used on electromagnets, solenoids, transformers, motors, relays and the like, are frequently wound with small diameter magnet wire, which is relatively fragile. The magnet wire is usually insulated by a thin coat of varnish or a synthetic resin, which is adequate for insulation between adjacent turns on the coil. Neither the small solid wire nor its insulation is satisfactory for use in making external connections. The end of the magnet wire is therefore joined to a larger diameter flexible lead wire, having a thicker flexible insulation, that is better adapted for making external connections. In the past the junction between the magnet and lead wires has been insulated from the coil as by a layer of fish paper and held in place by a layer of adhesive electrical tape. This did not provide a satisfactory anchor for the lead wire, which, upon being pulled, could break the magnet wire or pull it off of the coil. The lead wire was passed through one or more holes in the flange of the bobbin on which the coil was wound. Knots in the lead wires and various clamping devices were used to prevent pulling the lead wires from the holes. These solutions proved time consuming and unsatisfactory. Terminals were mounted on the bobbin flange and the magnet and lead wires were soldered to the terminals. This was time consuming and left an uninsulated terminal. None of these provided a satisfactory solution to the problem.

SUMMARY OF THE INVENTION

According to this invention the magnet and lead wires of an electrical coil are joined together by a connector having a transverse dimension larger than the diameter of the lead wire, after which the wires are retained by a wire holder mounted upon the coil. The wire holder positions the wires, relieves strain on the magnet wire and insulates the wire junction from the magnet wire wound on the coil. Barriers are provided to insulate a plurality of wire junctions from each other. Means are provided for positioning the holder on the coil. The coil and holder are covered with insulating material, which also retains the holder in fixed position on the coil and provides mechanical protection.

DESCRIPTION OF THE PREFERRED EMBODIMENTS

Figure 1:
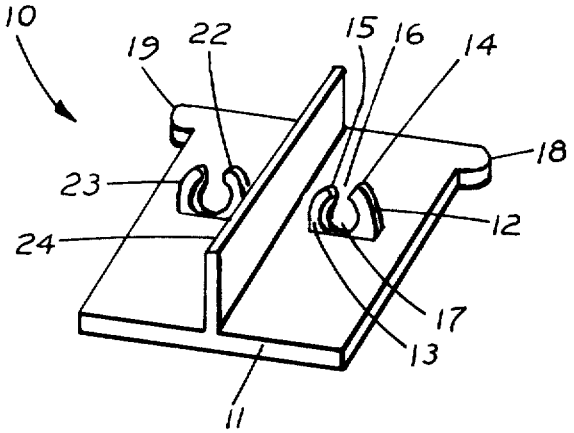
FIG. 1 is a perspective view of a preferred embodiment of the wire holder.
Figure 2:
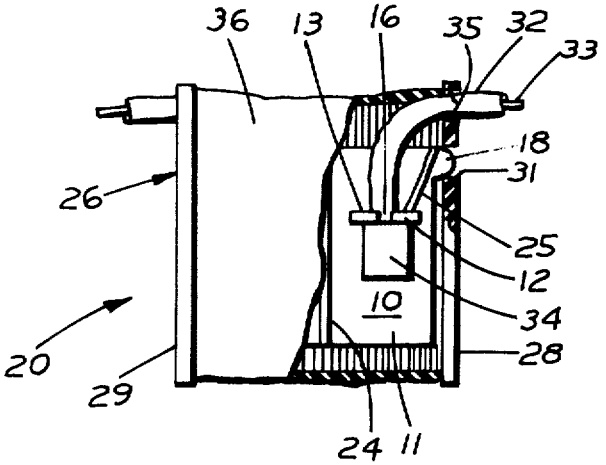
FIG. 2 is a view of a coil partially cut-away substantially along the line 2—2 in FIG. 4, with a wire holder mounted thereon and showing how the wires are retained by the wire holder.

As seen in FIG. 1 the wire holder 10 comprises a rigid plane base 11 of insulating material from the surface of which a pair of spaced projections 12, 13 extend in a perpendicular plane. Ears 14, 15, extending toward each other at the ends of projections 12, 13 respectively, define a gap 16 and partially enclose a space 17 between the projections. Protuberances 18, 19 provide means for attaching the wire holder to a coil 20 as shown in FIG. 2 and described later. A second pair of projections 22, 23, similar to projections 12, 13 are separated from the latter by an insulating barrier 24, perpendicular to the base. The wire holder is preferably molded in one piece.

In FIG. 2 the wire holder 10 is mounted on a coil 20. The coil is formed by winding magnet wire 25 on a coil form or bobbin 26. The bobbin comprises a tubular portion 27 terminating in flanges 28, 29 — all of insulating material. The wire holder 10 is positioned between flanges 28, 29 to prevent sidewise movement and the protuberances 18, 19 are engaged in holes, such as 31 in flange 28 receiving protuberance 18, to provide an interlocking mechanical fastening, preventing longitudinal motion.

Figure 3:
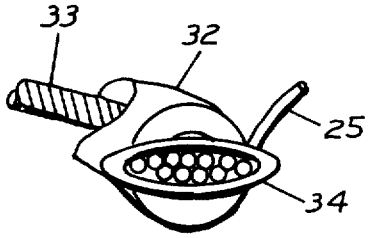
FIG. 3 is an end view of a solderless connection suitable for use with the wire holder.

FIG. 3 shows a covering 32 of resilient insulation, such as rubber or vinyl, on a stranded lead wire 33, joined to magnet wire 25 in side-by-side relationship by a solderless connector 34. The solderless connector shown was originally a cylindrical metal tube that was subsequently flattened over the bared adjacent ends of wires 25, 33 to form an electrical connection. Some solderless connectors do not require baring the ends of the wires. For this application at least one transverse dimension of the connection must be larger than the diameter of the insulation covering 32 for reasons to be presented later.

Going back to FIG. 1, the gap 16 between ears 14, 15 is narrower than the outside diameter of the insulation 32, but wide enough to permit passage of the insulated wire 33 laterally therethrough when the insulation is squeezed. The partially enclosed space 17 is of sufficient area to snugly confine the insulated wires 25, 33 and of such dimensions as to prevent passage of the connector 34 lengthwise therethrough. After the insulated wires 25, 33 have been passed laterally through the gap 16 into space 17, as seen in FIG. 2, they are prevented from transverse movement with respect to the base 11. Lengthwise movement of the wires 25, 33 through the space 17 when lead wire 33 is pulled is prevented after the enlarged connection 34 abuts the projections 12, 13, as shown. This relieves tension on magnet wire 25. The connector 34 is insulated from the magnet wire 25 wound on the bobbin 26 by the base 11 and from a similar adjacent connector (not shown) by barrier 24. Flange 28 provides insulation of the connector 34 from external conductors along the axis of the coil 20. The insulated lead wire 33 is passed through a hole 35 in flange 28 to limit the direction from which the lead wire 33 can be pulled with respect to the wire holder 10 and to further define the location of the lead wire. A layer 36 of insulation, such as electrical tape, formed over the magnet wire 25 wound on the bobbin 26, the wire holder 10 and connector 34, prevents outward movement of the wire holder 10 with respect to the coil 20, insulates the magnet wire 25 and the connector 34 from external electrical conductors and provides mechanical protection to the coil. Outward movement of the wire holder 10 from coil 20 could also be prevented by additional interlocking portions such as 18, 31.

Figure 5:
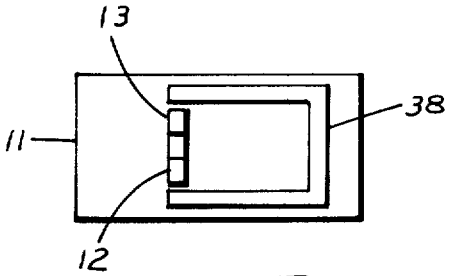
FIg. 5 is a plan view of another embodiment of the wire holder.
Figure 4:
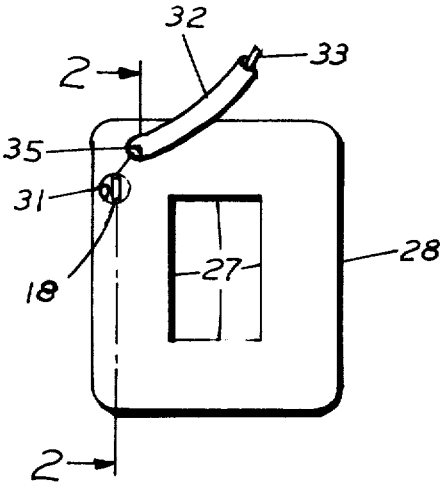
FIG. 4 is an end view of the coil in FIG. 2

FIG. 5 shows in plan another embodiment of the invention, in which the base 11 and projection 12, 13 are the same as in FIG. 1, but an insulating barrier 38, shown as comprising three straight sides, along with the base 11 and projections 12, 13 provide all the insulation required, except from the top, for a connector, such as 34, enclosed thereby. The projections could be integral with the barrier.

The embodiments shown and described are merely exemplary. They do not establish the limits of the invention, which are defined by the claims. Many other embodiments will be readily apparent to those skilled in the art. It will be obvious that the steps recited in the claims need not necessarily be performed in the order in which they are presented.

I claim:

1. A method for retaining a connection between insulated magnet and lead wires in fixed position on a coil and insulating the connected wires from magnet wire wound on the coil comprising the steps of positioning the wires side-by-side and with adjacent ends, joining the adjacent ends in an electrical connection having a transverse dimension larger than the diameter of the insulated lead wire, squeezing the insulated parallel wires transversely through a gap into a snugly confining space between projections from the surface of an insulating base, and affixing said base to the coil.

2. A method according to claim 1 further comprising forming a layer of insulation over the assembled magnet wire wound on the coil, the base and the connection.

3. A method according to claim 1 wherein said affixing of the base to the coil comprises interlocking portions of said base and said coil.

* * * * *